US005501352A

United States Patent [19]

Apps

[11] Patent Number: 5,501,352

[45] Date of Patent: Mar. 26, 1996

[54] HEIGHT EXTENSION FOR CRATES AND THE LIKE

[75] Inventor: William P. Apps, Anaheim, Calif.

[73] Assignee: Rehrig Pacific Company, Inc., Los Angeles, Calif.

[21] Appl. No.: 69,779

[22] Filed: Jun. 1, 1993

[51] Int. Cl.[6] ..... B65D 27/00

[52] U.S. Cl. ..... 220/4.26; 220/509; 220/516; 220/517; 220/519; 206/144; 206/203; 206/506; 206/511; 206/512; 206/517; 206/518; 206/519; 206/563

[58] Field of Search ..... 220/4.26, 4.27, 220/4.21, 509, 510, 516, 517, 518, 519, 691, 693; 206/144, 203, 505, 506, 509, 511, 512, 517, 518, 519, 562, 563, 565

[56] References Cited

U.S. PATENT DOCUMENTS

| | | | |
|---|---|---|---|
| 2,840,256 | 6/1958 | Cobb, Jr. | 220/4.26 |
| 3,251,460 | 5/1966 | Edmonds | 220/4.26 X |
| 3,283,915 | 11/1966 | Maslow | 220/510 X |
| 3,327,885 | 10/1966 | Carle et al. . | |
| 3,368,709 | 2/1968 | Waller | 220/510 |
| 3,643,812 | 2/1972 | Mander et al. . | |
| 4,093,101 | 6/1978 | Braun . | |
| 4,621,739 | 11/1986 | Heymann et al. . | |
| 4,693,371 | 9/1987 | Malpass . | |
| 4,718,555 | 1/1988 | Amberg . | |
| 4,867,315 | 9/1989 | Baldwin . | |
| 4,928,841 | 5/1990 | Arthurs | 206/203 X |
| 4,961,500 | 10/1990 | Coulombe . | |
| 4,978,002 | 12/1990 | Apps et al. | 206/201 |
| 5,097,980 | 3/1992 | Warwick . | |
| 5,142,445 | 8/1992 | Sorensen et al. | 220/4.26 X |
| 5,186,479 | 2/1993 | Flowers | 206/511 X |

*Primary Examiner*—Allan N. Shoap
*Assistant Examiner*—Stephen Cronin
*Attorney, Agent, or Firm*—Banner & Allegretti, Ltd.

[57] ABSTRACT

A height extension for use on top of a crate having a wall structure which extends the height of the wall structure of the crate to more stably retain containers. The extension of the present invention can be used with nestable and stackable crates to increase the heights of the crates without expensive replacement of the crates. It is particularly well suited for use with crates holding taller or differently shaped bottles. The extension also does not interfere with the nesting and stacking capabilities of the crates so that handling is not effected in any way since crates equipped with extensions are compatible with existing crates.

6 Claims, 12 Drawing Sheets

HEIGHT EXTENSION FOR CRATES AND THE LIKE

BACKGROUND OF THE INVENTION

The present invention relates to a height extension device for use on top of a low depth crate or tray for retaining and transporting containers. The extension increases the height of the crate or tray to more stably retain containers loaded therein without limiting the stacking and nesting abilities of the crate. The extension is especially well suited for use with bottle crates.

Bottles, particularly for soft drinks and other beverages, are often stored and transported during the distribution stages thereof in crates or trays. The term "crate" as used herein includes trays and similar containers having a bottom and peripheral sidewalls. These crates generally are configured to be stacked on top of each other when loaded with bottles. The crates also are configured to be nested together when empty of bottles. The crates provide advantages such as conservation of storage space are efficient, easy handling. In order to minimize the storage space of the crates when nested and to reduce cost and weight, many crates today are made with a shallow peripheral wall. These generally are referred to as "low depth" crates. Crates having a higher peripheral wall generally are referred to as "full depth" crates. "Full depth " crates stack on themselves empty or full of bottles, anything that uses the bottle for supporting the load is considered a "low depth" crate. Low depth crates are generally referred to as ¼-depth, ⅓-depth, ½-depth, etc.

The sidewalls and internal supports and dividers of a full depth crate extend above the bottles within the crate and thus generally do not require the bottles to support any of the load. However, the nested heights of empty, stacked full depth crates is greater than that of low depth crates. Low depth crates also are generally less expensive and lighter in weight than similarly constructed full depth crates. Thus, low depth crates are used extensively.

Low depth bottle crates for PET plastic bottles of one, two or three liter capacity have generally been designed for traditionally shaped bottles having a straight-cylindrical body with tapering tops. An example of a known bottle crate is disclosed in commonly assigned U.S. Pat. No. 4,978,002 to Apps, et al, the disclosure of which is hereby incorporated by reference in its entirety.

However, if a bottler uses taller bottles or bottles having different shapes, the known low depth bottle crates may not retain the bottles as stably as necessary for stacking and transporting loaded crates. Thus, for these taller or differently shaped bottles, it may be preferred to use a higher depth crate. However, replacing a bottler's supply of low depth crates with ones which accommodate the taller or differently shaped bottles would be very expensive and inefficient. For those bottles requiring a higher depth crate, it would be desirable to be able to convert a low depth crate to a higher depth crate. Thus, there is a need for a device for use with existing low depth crates which more stably retains taller or differently shaped bottles. The device also must not interfere with the stacking and nesting capabilities of the crates. The device also should be readily attachable and removable so that the crate can be easily converted to either a low depth or higher depth crate, as desired for a particular application.

SUMMARY OF THE INVENTION

Accordingly, it is a principal object of the present invention to provide an easily removable and attachable extension device for use with nestable and stackable crates to increase the height of the walls of crates. The extension is particularly well suited for use with crates holding taller or uniquely shaped bottles.

Another object of the present invention is to provide an extension for nestable and stackable crates which does not interfere with the nesting and stacking capabilities of the crates.

Still another object of the present invention is to provide an extension for crates which is configured to be secured to and mate with the sidewalls of the crate, and which has structural features enabling the extension to nestably receive a crate thereon when empty of bottles.

A still further object of the present invention is to provide an extension for crates having container compartments to stably support the bottles.

Another object of the present invention is to provide an extension to crates wherein the container compartments within the extension are sized smaller than any container receiving areas of the crate in order to retain bottles which may not have been held stably in the crate without the extension.

Directed to achieving these objects, an extension for use with nestable and stackable crates to increase the heights of the crates to more stably retain containers is herein provided. The preferred configuration is for use on the crate disclosed in commonly assigned U.S. Pat. No. 4,978,002 to Apps, et al, although the invention is not restricted to a crate of any specific design.

Preferably, the extension is formed by integrally molding from plastic a wall structure which mates with the wall structure of the crate. The extension may mate with the peripheral walls of the crate, the internal walls defining any container compartments, or with both the peripheral walls and the internal walls.

The extension is configured to nestably receive a crate, or another extension, when empty of containers, so that the usual handling of the crates is not at all affected by crates equipped with extensions. Crates having extensions nest and stack in the same way as the crates alone.

The extension may have internal walls, such as dividers and supports, integrally molded within its wall structure which may align with similar dividers and supports of the crate therebeneath. Any structural elements of the crate which aid in nesting and stacking can be incorporated into the extension so that these structural elements from the crate are duplicated in the extension. The structure of the extension may be substantially identical to the structure of the crate, except that the extension has no floor or bottom to support bottles.

These and other features and advantages of the invention may be more completely understood form the following detailed description of the preferred embodiments of the invention with reference to the accompanying drawings.

DETAILED DESCRIPTION OF THE PREFERRED EMBODIMENTS

Figure 1:
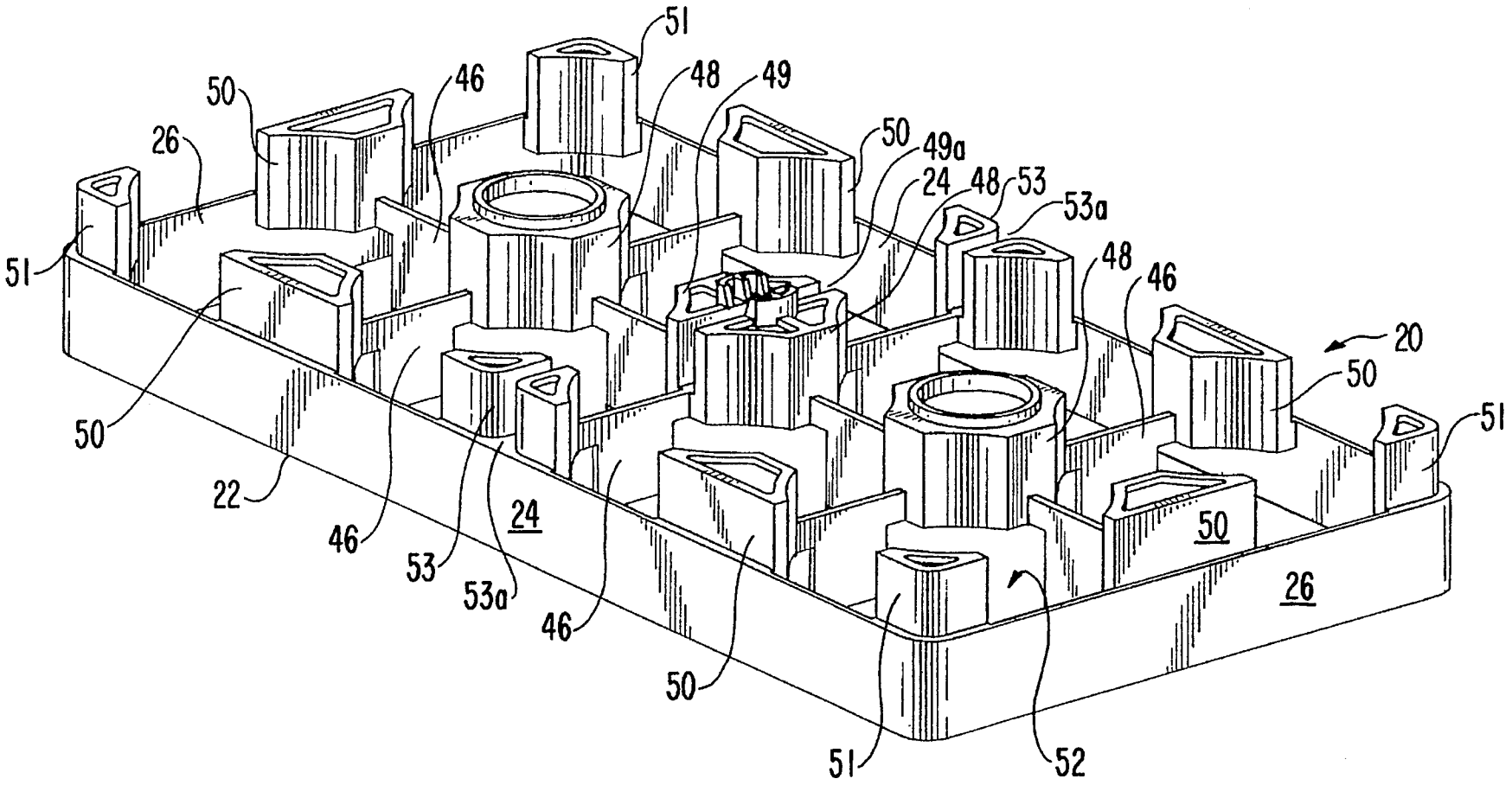
FIG. 1 is a perspective view of the top of the extension in accordance with the preferred embodiment of the present invention.
Figure 2:
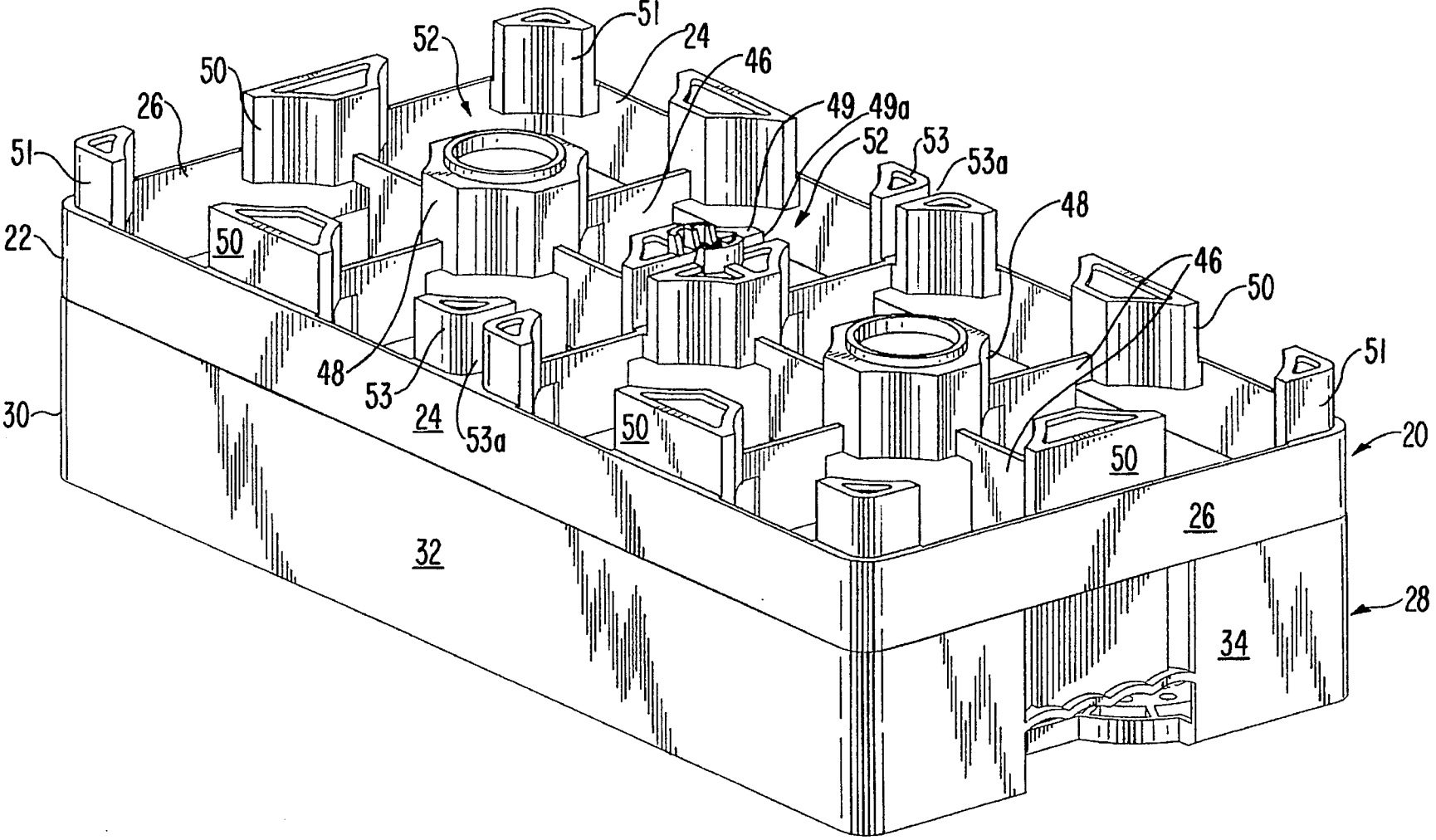
FIG. 2 is a perspective view of the top of the extension mounted on a crate.

As shown in FIG. 1, the extension 20 has a wall structure 22 having sidewalls 24 and endwalls 26. Sidewalls 24 are relatively long and endwalls 26 are relatively short. FIG. 2 shows extension 20 mounted on top of a crate 28, the crate having a crate wall structure 30 with crate sidewalls 32 and crate endwalls 34. When extension 20 is mounted to crate 28, wall structure 22 of the extension is preferably coextensive with crate wall structure 30 such that sidewalls 24 act as extensions of corresponding crate sidewalls 32, and endwalls 26 act as extensions of corresponding crate endwalls 34. In this way, wall structure 22 of extension 20 extends the height of crate wall structure 30, preferably around the entire perimeter of the crate.

It will be understood that the terms container and bottle are used in a broad sense, and encompass any type of receptacle including jars and cans.

Figure 3:
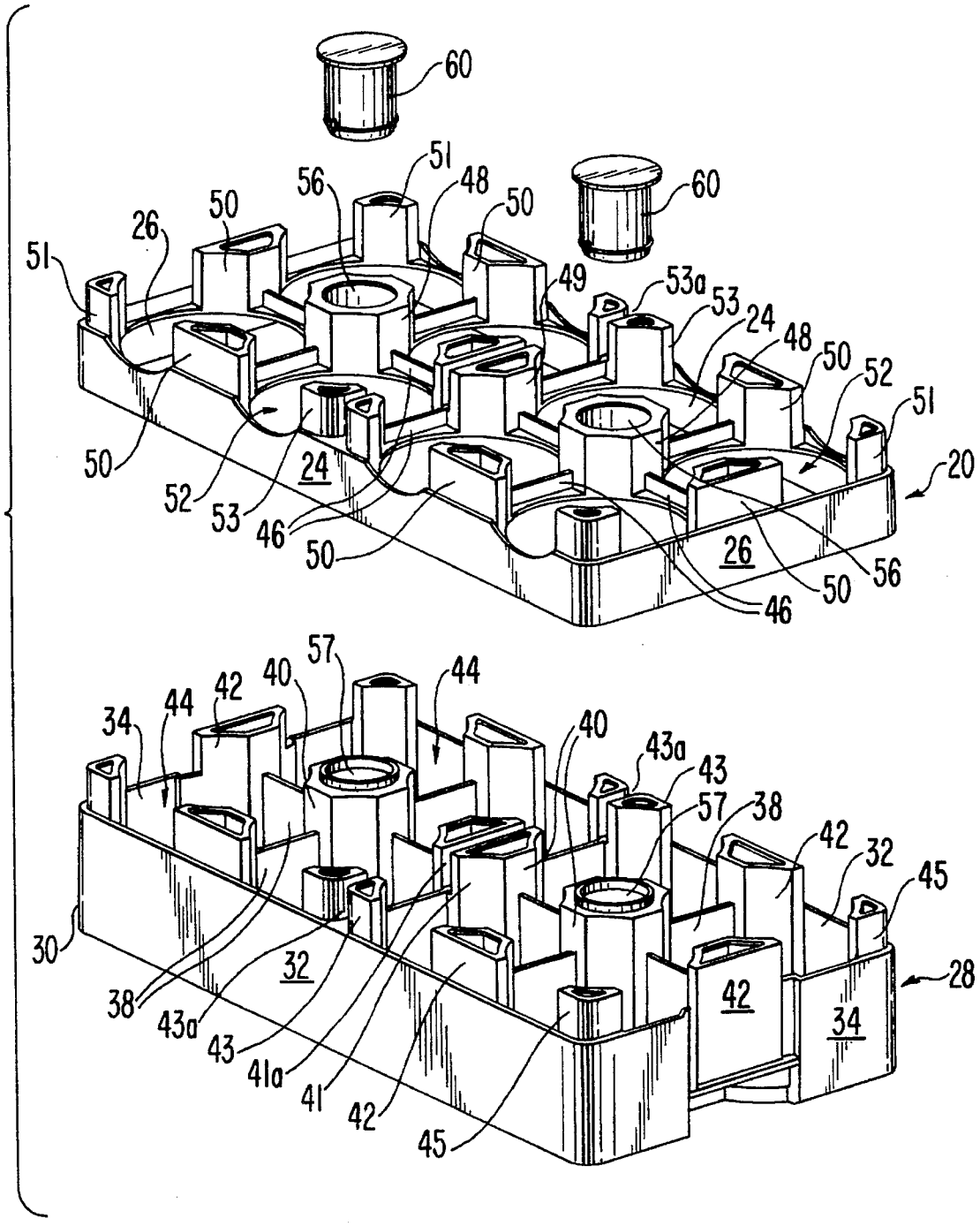
FIG. 3 is an exploded perspective view of the extension, locking pins and crate.

FIG. 3 shows extension 20 and crate 28 in an exploded perspective view to illustrate a preferred embodiment of the extension. A complete description of the extension must follow a description of the preferred embodiment of crate 28. Crate 28, besides having crate peripheral wall structure or outer shell 30, has a floor or bottom 36, best shown in FIG. 13; an internal wall structure, including crate dividers 38 disposed within the crate peripheral wall structure; crate internal supports or columns 40 also disposed within the crate peripheral wall structure at the intersections of crate dividers 38; crate peripheral supports or columns 42 disposed at the intersections of crate dividers 38 and crate wall structure 30, and which are a subpart of crate wall structure 30; and crate corner supports 45. Floor 36 of the crate has a plurality of container receiving areas which preferably correspond to container or bottle retaining pockets 44 defined by crate dividers 38 and crate wall structure 30. The number of container pockets 44 does not necessarily have to correspond with the number of container receiving areas. Crate internal supports 40; crate peripheral supports 42 and crate corner supports 45 preferably extend above the top of crate wall structure 30. Crate 28 preferably is a low depth crate, meaning that a minimum of material is used to provide stable support for containers loaded therein. However, the extension may be used with a crate of any shape or configuration, and having any type of bottle supporting structure.

In the preferred embodiment of crate 28, supports 40, 42 and 45 provide support surfaces above the top of the wall structure to stably hold containers in the crate. Crate internal supports 40, crate peripheral supports 42 and crate corner supports 45 are hollow columns generally shaped as shown in FIG. 3. The shapes of supports 40, 42 and 45 are important because they provide stable nesting of one crate directly on top of another crate. In other words, crate 28, when empty of containers or bottles, nestably and matingly receives another similar crate directly thereabove. Since supports 40, 42 and 45 are hollow, at least portions of crate internal supports 40 of a lower crate may be disposed within portions of respective crate internal supports in an upper crated nested thereabove. Similarly, at least portions of crate peripheral supports 42 of a lower crate may be disposed within portions of respective crate peripheral supports in an upper crate nested thereabove; and at least portions of crate corner supports 45 of a lower crate may be disposed within portions of respective crate corner supports in an upper crate nested thereabove. In this manner, empty, nested crates form a stable, self-supporting, male-female type interlocking stack and save valuable storage space.

Another feature of the preferred embodiment of crate 28 concerns specially configured supports 41 and 43 which are preferably aligned across the crate in a line which is parallel to endwalls 34. Center crate support 41 is an internal crate support similar to the other internal crate supports 40, but being split into two halves by a slot or recess 41*a*. Each of the halves of center crate support 41 is preferably shaped like a peripheral crate support 42. Split crate supports 43 are generally shaped like a peripheral crate support 42, but being split into two halves by slots or recesses 43*a*. The purpose of the slots 41*a* and 43*a* is to enable crate 28, when empty, to receive another crate thereabove in a cross-stacked configuration. The cross-stacked configuration is an upper crate rotated 90 degrees relative to a lower crate. The slots 41*a* and 43*a* on crate center support 41 and split crate supports 43, respectively, provide for a stable, self-supporting, male-female interlocking relationship between empty crates in the cross-stacked configuration. Cross-stacking is useful for forming a large quantity of crates into a pallet which can be handled by machinery such as forklifts.

Referring again to FIG. 3, if even more stability is desired, or if bottles to be loaded into crate 28 are taller or differently shaped such that the support surfaces of supports 40 and 42 do not sufficiently support the bottles in the crate, an extension 20 in accordance with the present invention can be mounted on top of crate 28 to increase the height of the wall structure. Extension 20, besides having the extension peripheral wall structure 22 comprised of sidewalls 24 and endwalls 26, preferably has other structural elements corresponding to the structure of the crate. A preferred embodiment of extension 20 is shown, although it will be appreciated that the extension of the invention need only be of a size and configuration to extend the height of the peripheral and/or internal walls of the crate.

In the preferred embodiment, extension 20 has internal walls including extension dividers 46 disposed within the extension peripheral wall structure; extension internal supports or columns 48 also disposed within the extension peripheral wall structure at the intersections of extension dividers 46; extension peripheral supports or columns 50 disposed at the intersections of extension dividers 46 and extension wall structure 22, and which are a subpart of extension wall structure 22; and extension corner supports 51.

Extension dividers 46 along with extension wall structure 22 define container compartments or retaining openings 52 into which containers are inserted. Container compartments 52 are preferably aligned vertically with container pockets 44 of crate 28. The preferred embodiment of the extension has a one-to-one correspondence of container compartments to container pockets of the crate. In other words, each container compartment 52 is sized to receive a single container, as is the respective container pocket. However, any configuration of extension dividers is contemplated to be within the scope of the present invention. For instance, container compartments 52 may be sized for multiple containers, and respective container pockets 44 being of corresponding number and size.

Alternately, the number of container compartments 52 and container pockets 44 of the crate may not correspond. An example of which may be a crate having no dividers having an extension mounted thereto which has single container compartments. The converse is also possible, that is, a crate having single container pockets having an extension mounted thereto which has no dividers, only a wall structure. Also, container compartments 52 may be smaller in size than the corresponding container compartments 44 of crate 28. This would allow the walls of the compartments 52 more stably to support a container which has, for example, an upwardly tapering shape or an upper area of different diameter than its lower area. Also, the extension may extend the height only of any internal dividers and supports without extending the height of the peripheral sidewalls of the crate. The term "wall structure" of the extension is intended to broadly include the peripheral walls, the internal walls such as the internal dividers and supports, or both.

Extension internal supports 48; extension peripheral supports 50 and extension corner supports 51 preferably extend above the top of extension wall structure 22. Supports 48, 50 and 51 provide support surfaces above the top of the extension wall structure to stably hold a container in the crate. In the preferred embodiment of extension 20, supports 48, 50 and 51 are hollow columns generally shaped as shown in FIG. 3. Since supports 48, 50 and 51 are hollow, at least portions of crate internal supports 40 of the crate may be disposed within portions of respective extension internal supports 48 of the extension mounted thereabove. Similarly, at least portions of crate peripheral supports 42 of the crate may be disposed within portions of respective extension peripheral supports 50 of the extension mounted thereabove; and at least portions of crate corner supports 45 of the crate may be disposed within portions of respective extension corner supports 51 of the extension mounted thereabove.

Figure 4:
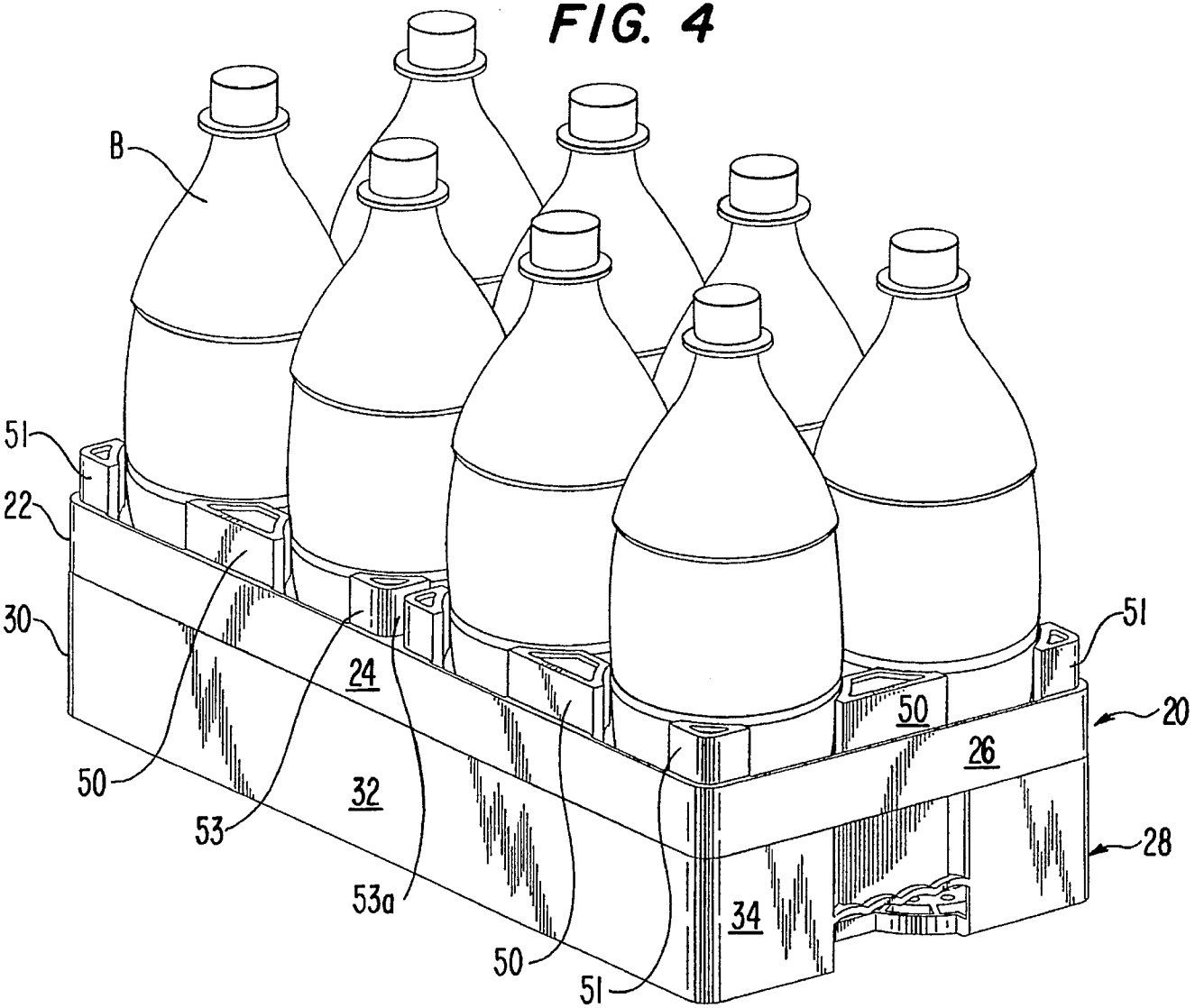
FIG. 4 is a perspective view of the extension mounted on a crate, as shown in FIG. 2, loaded with bottles.

The importance of the shapes of the extension supports is apparent from FIGS. 2–4. The structure of internal extension supports 48, peripheral extension supports 50 and corner extension supports 51 allows extension 20 to be mounted on crate 28, in much the same manner as an upper crate being nested above crate 28. In addition, since extension 20 has substantially identical structural features as crate 28 as far as the top surface of the crate is concerned, a crate with an extension, such as shown in FIG. 2, has the same nesting, stacking and cross-stacking capabilities as a crate without an extension.

To this end, extension 20 preferably has corresponding structural elements enabling crates to be cross-stacked on top of the extension. Extension 20 has specially configured supports 49 and 53 which are preferably aligned across the extension in a line which is parallel to endwalls 26. Center extension support 49 is an internal extension support similar to the other internal extension supports 48, but being split into two halves by a slot 49*a*. Each of the halves of center extension support 49 is preferably shaped like a peripheral extension support 50. Split extension supports 53 are generally shaped like a peripheral extension support 50, but being split into two halves by slots 53*a*. The purpose of the slots 49*a* and 53*a* is to enable a crate equipped with extension 20, when empty, to receive another crate thereabove in a cross-stacked configuration. The slots 49*a* and 53*a* on extension center support 49 and split extension supports 53, respectively, provide for a stable, self-supporting, male-female interlocking relationship between empty crates equipped with extensions in the cross-stacked configuration.

FIG. 4 illustrates a crate 28 equipped with an extension 20 and loaded with bottles B. As can be seen, the internal surfaces of peripheral and corner extension supports 50 and 51 provide supporting surfaces for the sides of bottles B. Although not shown, the internal extension supports 48 also provide supporting surfaces of the sides of bottles B.

Figure 5:
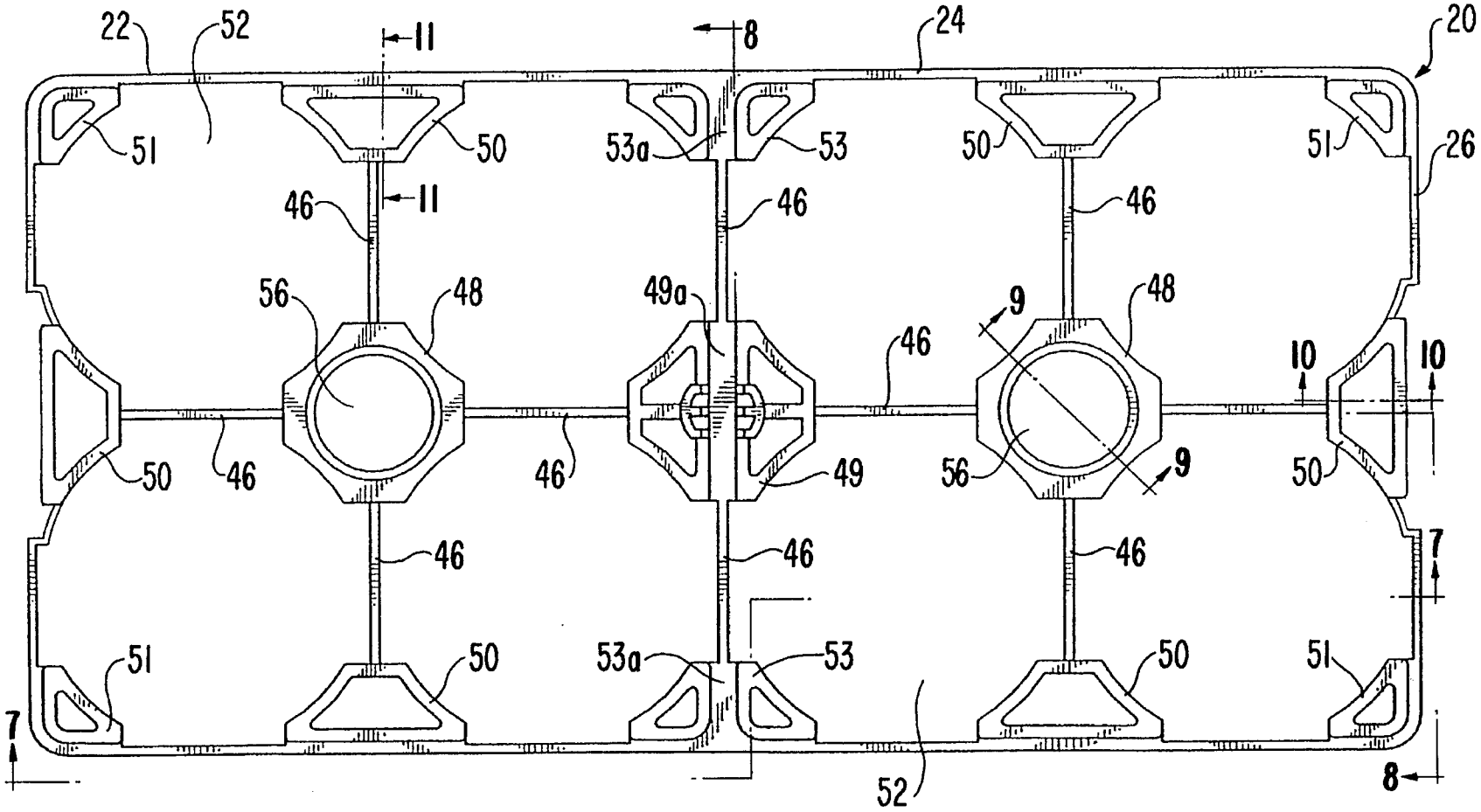
FIG. 5 is a top plan view of the extension of FIG. 1.
Figure 6:
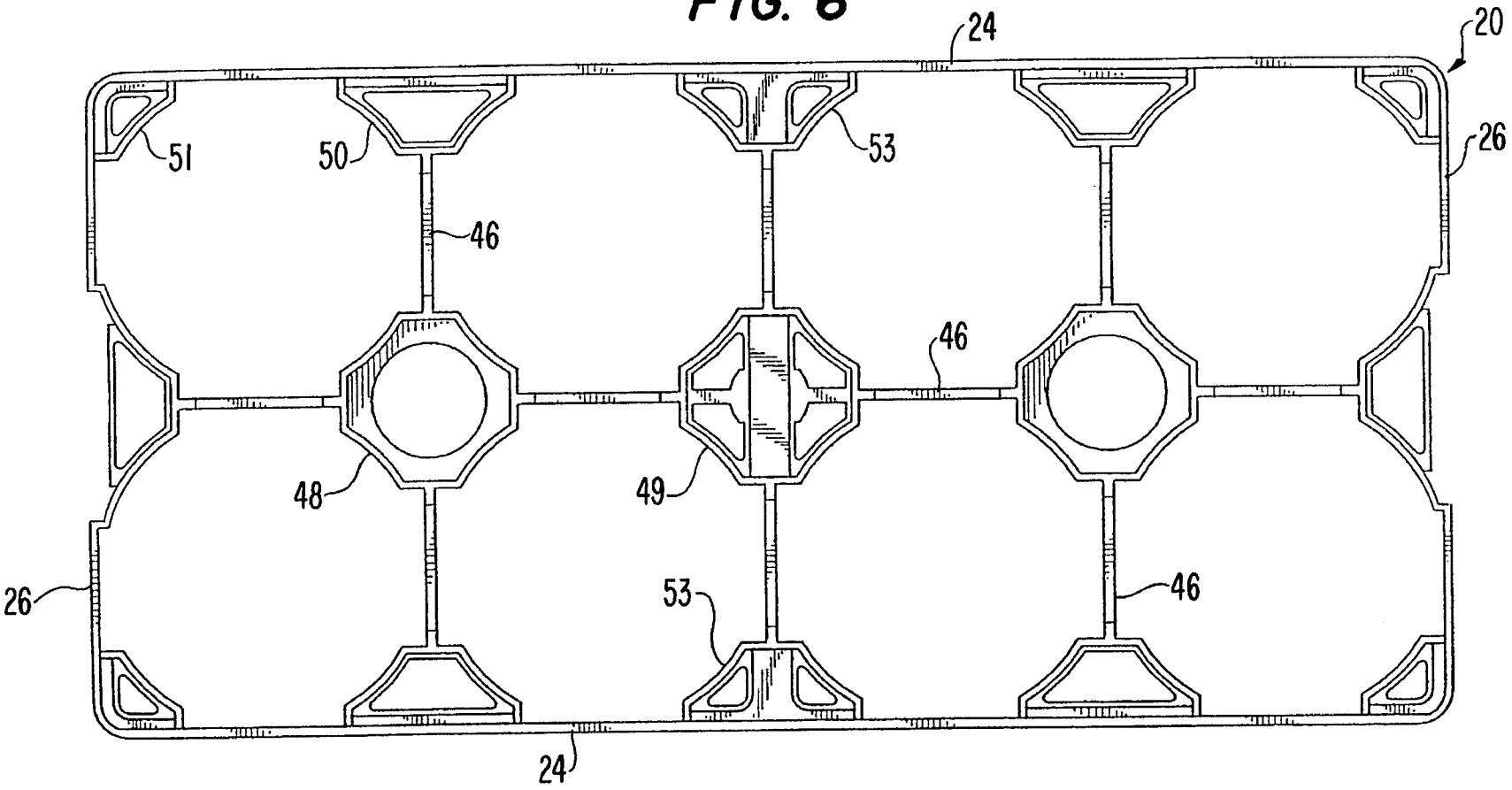
FIG. 6 is a bottom plan view of the extension of FIG. 1.
Figure 7:
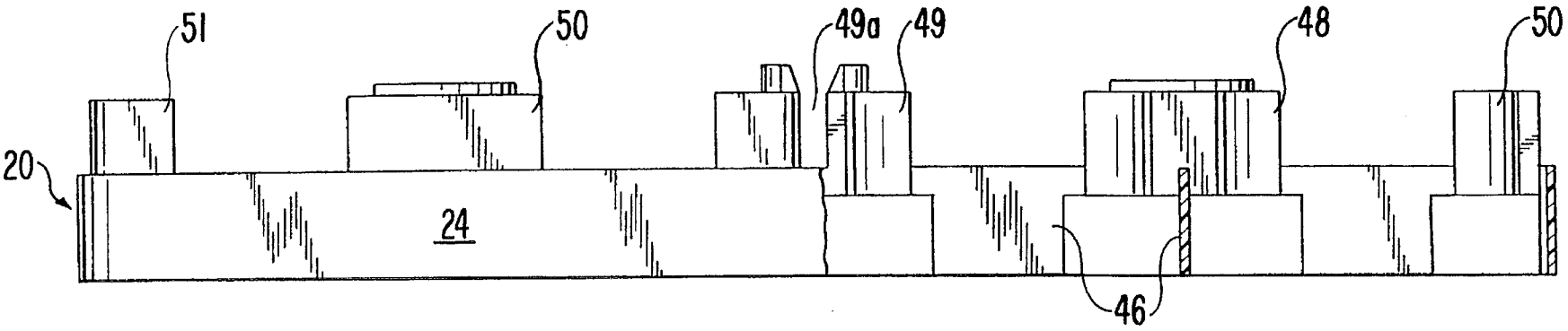
FIG. 7 is a side view of the extension, partially in section taken along line 7—7 of FIG. 5.
Figure 8:
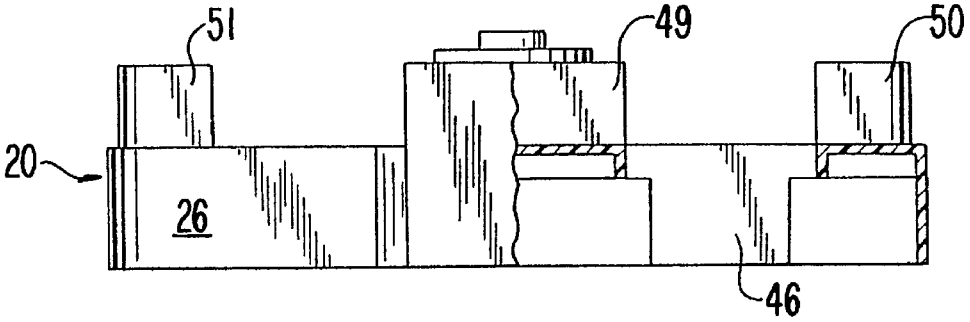
FIG. 8 is an end view of the extension, partially in section taken along line 8—8 of FIG. 5.
Figure 9:
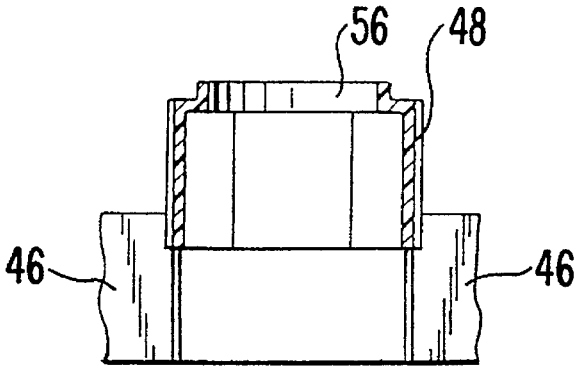
FIG. 9 is a sectional view taken along line 9—9 of FIG. 5.
Figure 10:
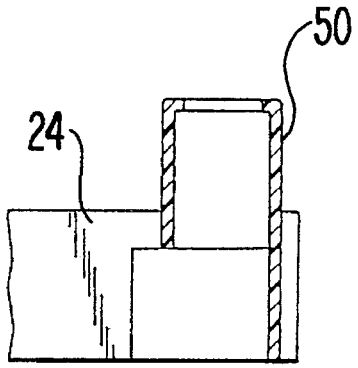
FIG. 10 is a sectional view taken along line 10—10 of FIG. 5.
Figure 11:
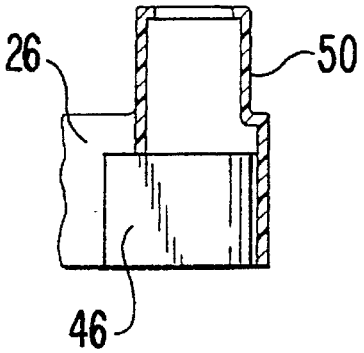
FIG. 11 is a sectional view taken along line 11—11 of FIG. 5.

FIG. 5 is a top plan view of a preferred embodiment of extension 20 having container compartments 52 sized for single containers. FIG. 6 is the bottom plan view of the extension and illustrates the undersides of hollow supports 48, 50 and 51. FIGS. 7 and 8 show the side and end elevational views of the extension, and the slot 49*a* in center extension support 49 is best illustrated in FIG. 7. A preferred embodiment of extension 20 has internal structural features such as dividers 46 and supports 48 and 49 which are coextensive with the corresponding elements of the crate. FIGS. 9–11 are detailed cross-sections of internal extension support 48 and peripheral extension supports 50. This preferred structure of extension 20 is preferred only in the context of use with the crate 28 as disclosed herein. As the structure of the base crate 28 changes, so too will the structure of extension 20.

Figure 12:
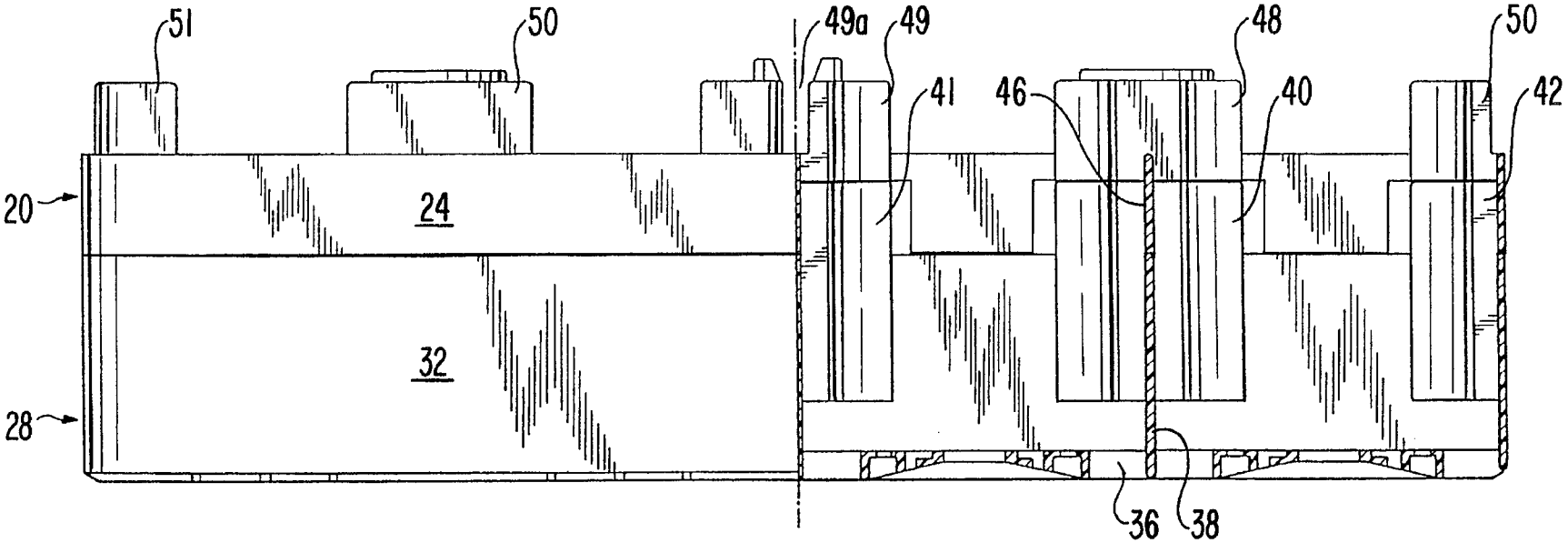
FIG. 12 is a sectional view similar to that of FIG. 9, which is taken along line 9—9 of FIG. 5, showing the extension mounted to a crate therebeneath.
Figure 13:
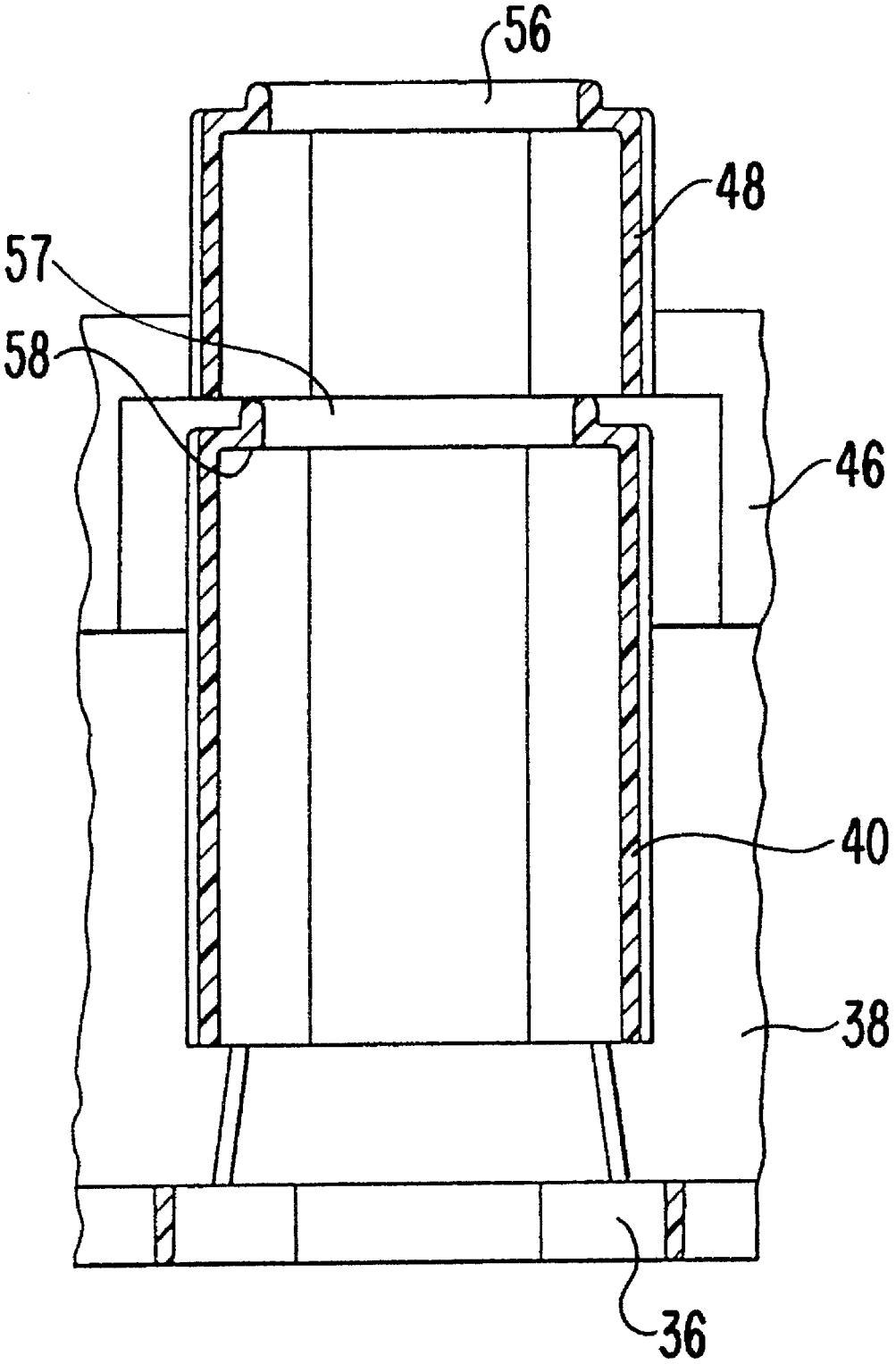
FIG. 13 is a sectional view similar to that of FIG. 7, which is taken along line 7—7 of FIG. 5, showing a side view of the extension mounted to a crate therebeneath.

FIG. 12 illustrates a side elevational view of a crate equipped with an extension showing crate dividers and supports being coextensive with corresponding ones of extension dividers and supports. FIG. 13 shows a detailed cross-section of an internal extension support 48 which is coextensive with an internal crate support 40 and supported thereon.

Figure 14:
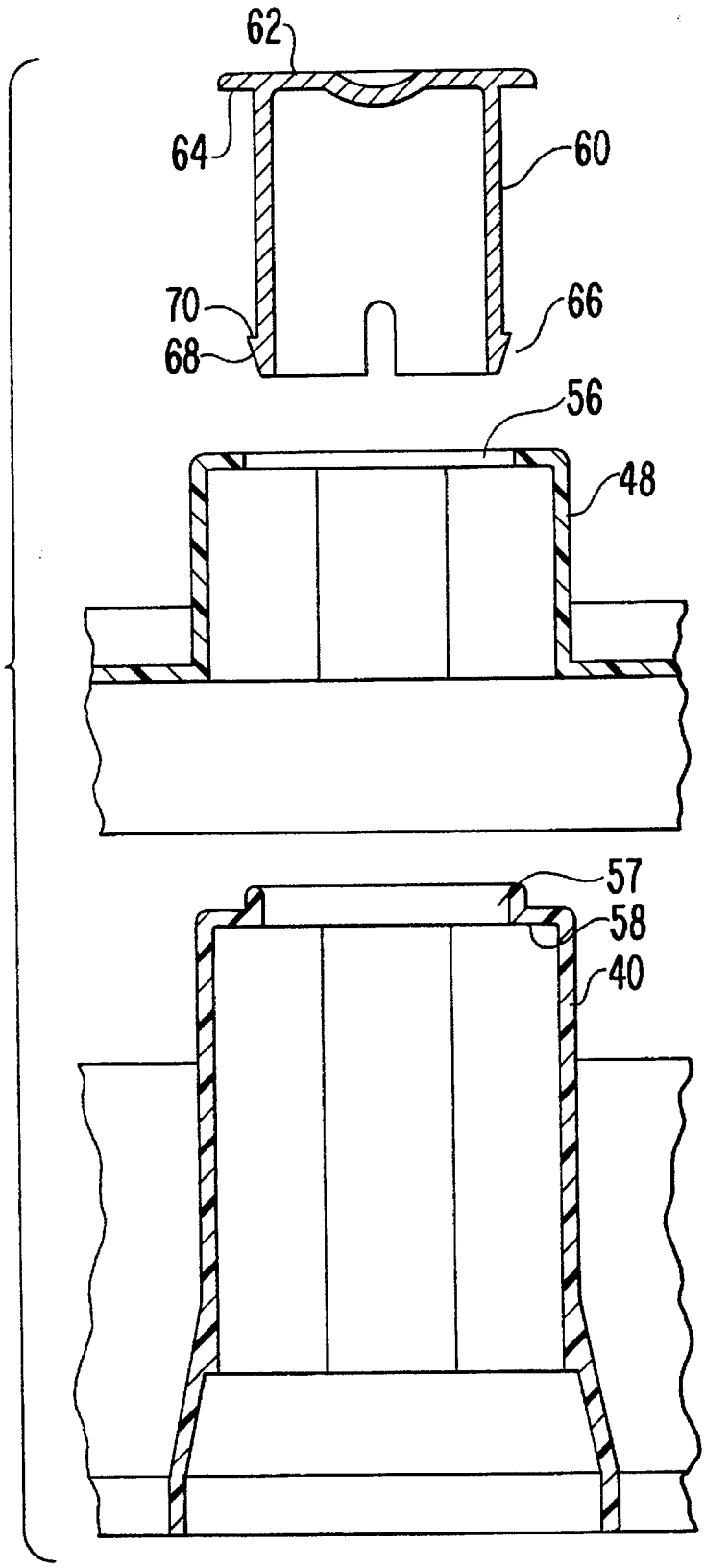
FIG. 14 is an exploded cross-section of the locking pin assembly shown in FIG. 3.
Figure 15:
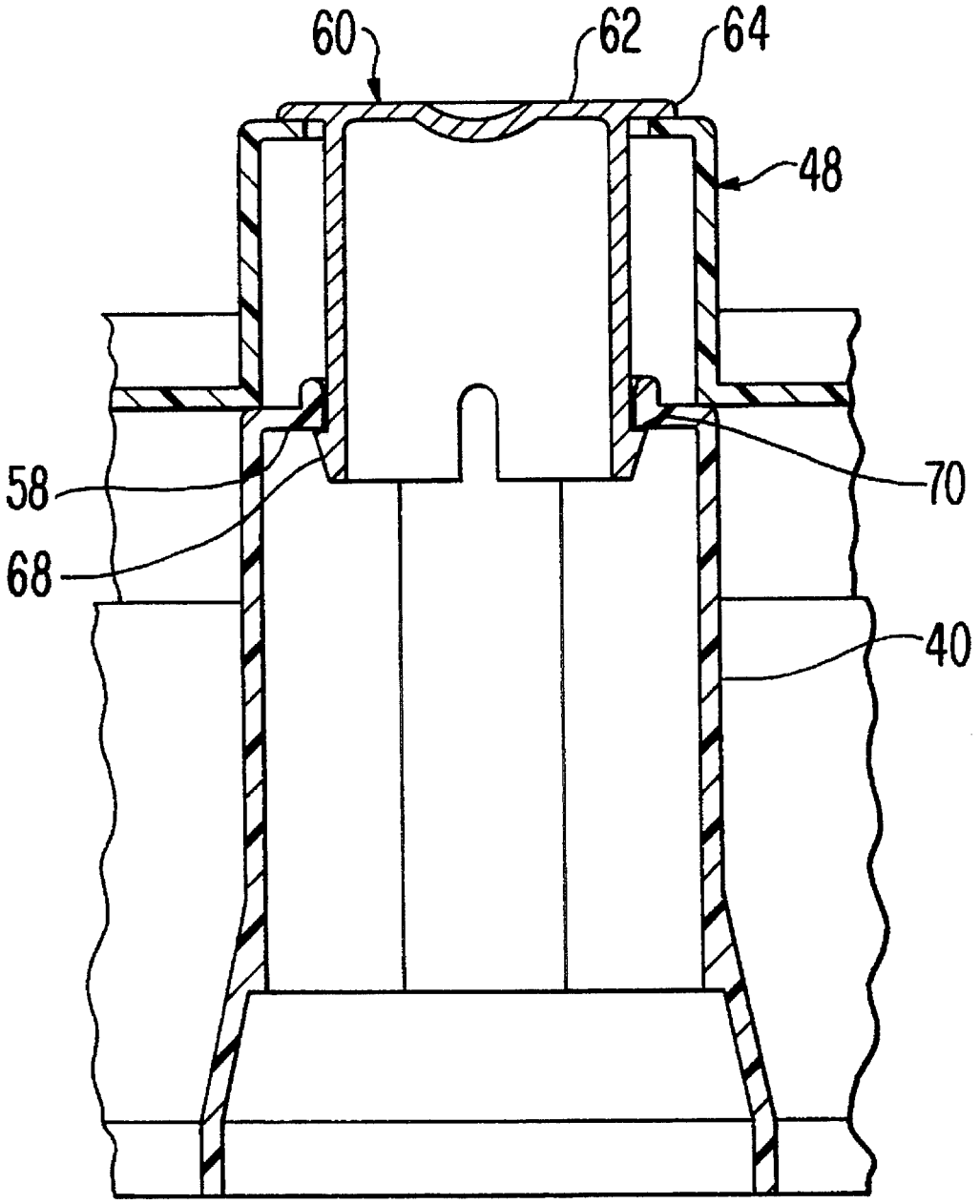
FIG. 15 is a cross-section of the locking pin assembly shown in FIG. 14 with the extension mounted and secured to a crate therebeneath by the locking pin.

FIGS. 14 and 15 are detailed views of the securing means by which an extension is secured to the crate on which it is mounted. A preferred securing means is also shown in FIG. 3 as well, and comprises locking pins 60 inserted into extension apertures 56 of internal extension supports 48. Locking pins 60 engage a portion of the crate therebeneath to securely hold the extension onto the crate. FIGS. 14 and 15 show an exploded view and an assembled view, respectively, of one internal extension support 48 and locking pin 60 combination. The preferred embodiment of crate 28 also has locking apertures 57 in the tops of internal crate supports 40. When the securing means is engaged between the crate and extension, locking pin 60 which is preferably a hollow cylinder closed on one end, is inserted into extension aperture 56, and in turn into locking aperture 57 of the crate. Locking pin 60 has an integral top cover 62 forming an annular top rim 64 and an annular bottom flange 66. Bottom flange 66 has a tapered side surface and a bearing surface 70 such that upon insertion into extension aperture 56 and locking aperture 57, side surface 68 slides past the rims of the apertures. When locking pin 60 is totally locked into place, bearing surface 70 of pin 60 bears against an abutment surface 58 associated with locking aperture 57 of the crate. In this manner, FIG. 15 shows locking pin 60 firmly inserted into both apertures 56 and 57 and securely joining the extension to the crate.

Although FIG. 3 shows two locking pins 60, any number of pins and locking aperture combinations may be used. The locking pin-locking aperture combination for securing the crate to the extension is a preferred means, but any other securing means is contemplated to be within the scope of the present invention. For instance, a simple interference fit between extension supports and crate supports when matingly joined may provide a sufficient securing means. Other mechanical means or chemical means, such as adhesives, could be used to join the crate to the extension. A releasable type of connection, such as the locking pin-locking aperture combination disclosed, or an interference fit, may be advantageous for versatility.

Although a preferred embodiment is illustrated in the drawings and described, any number of variations are possible to adapt the extension of the present invention for a bottler's needs. The extensions shown in FIGS. 1 and 3 show slight variations which are contemplated to be within the scope of the invention. The sidewalls and endwalls may be straight as shown in FIG. 1, or the sidewalls may be slightly scalloped as shown in FIG. 3. The dividers 46 may be plain vertical dividers as shown in FIG. 1 or may have a shelf-like feature extending inward toward the container compartment as shown in FIG. 3 to better support the containers. The particular geometry of the extension's structural features will depend upon such factors as the shapes and capacities of the containers, and the type of tray or crate on which it will be mounted.

It will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

I claim:

1. An extension for increasing the height of a crate and adapted to be mounted to the top of the crate for retaining and transporting bottles, the crate having outer side walls forming an outer shell, a crate bottom disposed substantially within the outer shell, a plurality of supporting means for supporting outer surfaces of bottles, generally disposed within the outer shell and each supporting means having at least one curved bottle supporting surface, the bottle supporting surfaces defining, in combination with the outer shell and the crate bottom, a plurality of bottle retaining pockets with at least one bottle supporting means associated with each pocket, and receiving means, generally disposed within the outer shell, extending above the height of a top surface of a first of said side walls and having a recess, for receiving a side wall of an upper identical crate when the lower cross-stacking crate is empty, said extension comprising:

an extension wall structure corresponding to the outer shell of the crate;

a plurality of extension means for supporting outer surfaces of bottles, generally coextensive with the supporting means of the crate, each extension means having at least one curved bottle supporting surface, said bottle supporting surfaces of said extension defining container retaining openings substantially coextensive with the bottle retaining pockets;

receiving means, generally disposed within said wall structure, extending above the height of a top surface of a first of said sidewalls and having a recess, for receiving a sidewall of an upper identical crate when said lower cross-stacking crate is empty; and locking means for locking said extension onto the crate so as to increase the depth of the bottle retaining pockets for stably retaining bottles shaped differently than the bottles retained by the crate alone, wherein each of said plurality of extension means defines an extension column and said receiving means is associated with one of said extension columns, each said extension column being coextensive with a crate column defined by the plurality of supporting means, and wherein said locking means comprises an extension aperture on at least one of said extension columns, said extension aperture adapted to be coextensive with a corresponding one of the crate columns, and a locking pin inserted through said extension aperture, said locking pin including an annular top rim adapted to overlie and cover said extension aperture and an annular bottom flange adapted to engage a portion of the crate column to securely hold said extension onto the crate.

2. The extension as in claim 1, wherein each of said plurality of extension means defines an extension column and said receiving means is associated with one of said extension columns, each said extension column being coextensive with a crate column defined by the plurality of supporting means.

3. The extension as in claim 1, wherein said container retaining openings are dimensionally smaller than the bottle retaining pockets.

4. An extension device adapted for use on top of a crate for retaining and transporting containers, the crate being nestable with other crates when empty of containers and stackable with other crates when holding containers, said extension comprising:

a wall structure configured to mate with the crate so as to extend the height of the crate to more stably retain containers within the crate; and locking means for securing said extension to the crate, said locking means having an aperture and a locking pin inserted into said aperture such that said locking pin locks onto a portion of the crate to securely join said extension to the crate, said locking pin comprising a cylindrical shank and an integral top cover forming an annular top rim and an annular bottom flange having a tapered side surface and a bearing surface such that when said pin is inserted into said aperture, said tapered side surface slides past an abutment of the crate and said bearing surface abuts against the abutment of the crate to thereby lock said extension to the crate;

wherein said extension being nestable with other crates when empty of containers and stackable with other crates when holding containers.

5. An extension in combination with a crate having a crate wall structure for retaining and transporting containers, wherein said crate is nestable with other crates when empty of containers and stackable with other crates when holding containers, said extension for use on top of said crate comprising:

an extension wall structure configured to mate with said crate wall structure to extend the height of said crate to stably retain containers; and mounting means for mounting said extension onto said crate such that said extension wall structure is stably supported on said crate wall structure, said mounting means having an aperture and a locking pin inserted into said aperture such that said locking pin locks onto a portion of said crate to securely join said extension to said crate, wherein said locking pin comprises a cylinder including an integral top cover forming an annular top rim and an annular bottom flange having a tapered side surface and a bearing surface such that when said pin is inserted into said aperture, said tapered side surface slides past an abutment around said locking aperture of said crate support and said bearing surface abuts against said abutment of said crate support to thereby lock said extension to said crate;

wherein said extension configured to nestably receive another crate thereon when empty of containers and stackably receive another crate when holding containers.

6. An extension in combination with a crate having a crate wall structure for retaining and transporting containers, wherein said crate is nestable with other crates when empty of containers and stackable with other crates when holding containers, said extension for use on top of said crate comprising:

an extension wall structure configured to mate with said crate wall structure to extend the height of said crate to stably retain containers; and a plurality of extension dividers disposed inside said extension wall structure defining container compartments sized to retain a single container, said extension dividers adapted to be coextensive with any crate dividers disposed inside said crate wall structure such that said container compartments of said extension are also adapted to be coextensive with said container receiving areas of said crate, said container compartments of said extension being dimensionally smaller than said container receiving areas of said crate;

wherein said extension is configured to nestably receive another crate thereon when empty of containers and stackably receive another crate when holding containers.

* * * * *